US009947444B1

(12) United States Patent
Lien et al.

(10) Patent No.: US 9,947,444 B1
(45) Date of Patent: Apr. 17, 2018

(54) MULTILAYER VARISTOR AND PROCESS FOR PRODUCING THE SAME

(71) Applicant: SFI Electronics Technology Inc., Taoyuan (TW)

(72) Inventors: Ching-Hohn Lien, Taoyuan (TW); Jie-An Zhu, Shanghai (CN); Zhi-Xian Xu, Taoyuan (TW); Ting-Yi Fang, Taoyuan (TW); Hong-Zong Xu, Taoyuan (TW)

(73) Assignee: SFI ELECTRONICS TECHNOLOGY INC., Taoyuan County (TW)

( * ) Notice: Subject to any disclaimer, the term of this patent is extended or adjusted under 35 U.S.C. 154(b) by 0 days.

(21) Appl. No.: 15/709,606

(22) Filed: Sep. 20, 2017

(30) Foreign Application Priority Data

Sep. 26, 2016 (TW) ..... 105131098 A

(51) Int. Cl.

| | |
|---|---|
| ***H01C 7/10*** | (2006.01) |
| ***H01C 17/06*** | (2006.01) |
| ***H01C 7/102*** | (2006.01) |
| ***H01C 17/28*** | (2006.01) |
| ***H01C 1/14*** | (2006.01) |

(52) U.S. Cl.
CPC ..... *H01C 17/06* (2013.01); *H01C 1/14* (2013.01); *H01C 7/102* (2013.01); *H01C 7/1006* (2013.01); *H01C 17/281* (2013.01)

(58) Field of Classification Search
CPC ..... H01C 17/06; H01C 17/281; H01C 1/14; H01C 7/1006; H01C 7/102
USPC ..... 338/20, 13
See application file for complete search history.

(56) References Cited

U.S. PATENT DOCUMENTS

| | | | | |
|---|---|---|---|---|
| 4,675,644 | A * | 6/1987 | Ott | H01C 7/1006 338/21 |
| 5,155,464 | A * | 10/1992 | Cowman | H01C 7/00 338/21 |
| 6,184,769 | B1 * | 2/2001 | Nakamura | H01C 7/112 338/20 |
| 6,743,381 | B2 * | 6/2004 | Cowman | H01C 7/1006 252/500 |
| 7,724,124 | B2 * | 5/2010 | Lien | B82Y 30/00 257/536 |
| 9,236,170 | B2 * | 1/2016 | Fu | H01C 7/1006 |
| 2014/0036408 | A1 * | 2/2014 | Kim | H01G 4/30 361/301.4 |
| 2016/0024346 | A1 * | 1/2016 | Inoue | C09D 163/00 361/301.4 |

* cited by examiner

*Primary Examiner* — Kyung Lee
(74) *Attorney, Agent, or Firm* — Bacon & Thomas, PLLC

(57) ABSTRACT

A process for producing a multilayer varistor (MLV) if remained its size unchanged as prior arts is favorable to outstandingly increase overall current-carrying area and improve the performance of final produced MLV; and the MLV has laminated a lower cap, an inner-electrode stack formed from piling up several inner-electrode gaps (g), and an upper cap into a unity, and at least satisfies the condition that the lower cap and the upper cap has a thickness smaller than a thickness of the inner-electrode gap (g), but equal to or greater than 0.1 times of the thickness of the inner-electrode gap (g).

12 Claims, 2 Drawing Sheets

MULTILAYER VARISTOR AND PROCESS FOR PRODUCING THE SAME

BACKGROUND OF THE PRESENT INVENTION

1. Field of the Invention

The present invention relates to multilayer varistors, and more particularly to a multilayer varistor having increased current-carrying area and process for producing the same.

2. Description of Related Art

ZnO-based varistors have excellent non-ohm properties and are frequently used in electric systems and circuitries as overvoltage protection devices for protecting electronic elements from damages caused by transient voltage surges.

As electronic products are designed more toward micro-miniaturization, thinness, integration and versatility, the latest development of ZnO-based varistor is multilayer varistor (hereinafter referred to as MLV).

As shown in FIG. 1 and FIG. 2, a known MLV 10 comprises a ceramic body 20 in which interdigitated inner electrodes 30 are arranged. The ceramic body 20 has two ends thereof each provided with an outer electrode 40. The outer electrodes 40 are in electrical connection with the interdigitated inner electrodes 30 inside the ceramic body 20. The ceramic body 20 has a sandwich-like structure that is physically a stack of a lower ceramic part 21 (hereinafter referred to as the lower cap 21) outside the inner electrodes 30, an inner ceramic part 22 (hereinafter referred to as the inner-electrode stack 22) inside the inner electrodes 30, and an upper ceramic part 23 (hereinafter referred to as the upper cap 23) outside the inner electrodes 30.

The known MLV 10 as described previously is made using known multilayer technology through the following steps:

1) preparing ceramic slurry containing mainly particles of zinc oxide (ZnO) (hereinafter referred to as the ZnO ceramic slurry);
2) forming the prepared ZnO ceramic slurry into green tapes each having a thickness of about 10-100 μm using tape casting;
3) piling plural said green tapes and laminating them into a lower cap 21 (or an upper cap 23) having a predetermined thickness (T), such as a lower cap 21 (or an upper cap 23) having a thickness up to 200 μm;
4) printing an inner electrode 30 on the preformed lower cap 21 using screen printing, wherein as shown in FIG. 1 and FIG. 2 the inner electrode 30 is such printed that the inner electrode 30 has only one end connected to either the left end or the right end of the lower cap 21, and that the two side edges of the inner electrode 30 are each separated from the corresponding edges of the lower cap 21 by a clearance (H) (hereinafter in the present invention referred to as the margin (H) of the inner electrode 30). Accordingly, the printed area of the inner electrode 30 is where this layer of inner electrode 30 allows impulse current caused by transient voltage to pass therethrough (hereinafter referred to as the current-carrying area of one inner-electrode layer 30), and the inner electrode 30 may be made of platinum (Pt), palladium (Pd), gold (Au), silver (Ag), nickel (Ni), or an alloy of two or more of the foregoing metals;
5) referring to a gap (G) spaced out between two adjacent inner electrodes 30 (hereinafter referred to as the inner-electrode gap (G)), piling one or more green tapes on the lower cap 21 made in the previous step until the thickness of the piled body reaches the predetermined inner-electrode gap (G), and printing another inner electrode 30 thereon using screen printing, so that this currently printing inner electrode 30 and the inner electrode 30 whose location is stacked below it are arranged in an interdigitated manner (hereinafter referred to as the interdigitated inner electrodes 30) with their one end alternately connected to the left end or the right end of the preform of MLV whose working stage is still in its stacking stage;
6) referring to the predetermined number of layers of the inner electrodes 30, repeatedly piling the green tapes to the height of the inner-electrode gap (G) and printing inner electrodes 30 in the interdigitated manner, until the inner-electrode stack 22 as planned is formed;
7) placing the prepared upper cap 23 onto the top of the inner-electrode stack 22, and laminating the upper cap 23, the inner-electrode stack 22 and the lower cap 21 into a unity as an MLV green body;
8) sintering the MLV green body in a sintering furnace at a sintering temperature of about 800-1000° C., so as to obtain an MLV sintered body; and
9) attaching outer electrodes 40 to two ends of the MLV sintered body, and sintering the MLV sintered body at 600-950° C. so as to obtain the MLV 10, wherein the outer electrodes 40 may be made of silver (Ag), cooper (Cu) or silver-palladium alloy.

The prior known MLV 10 has its disadvantages. Since the lower cap 21, the inner-electrode stack 22 and the upper cap 23 of the ceramic body 20 are made of the same material, the three have equal impedance, and particularly the MLV 10 is prevented from normal function unless the thickness (T) of the lower cap 21 (and the upper cap 23) as well as the margin (H) of the inner electrode 30 are greater than the inner-electrode gap (G). In other words, the following conditions R5-R7 must be satisfied:

R5. the thickness (T) of the lower cap 21 greater than the inner-electrode gap (G);

R6. the thickness (T) of the upper cap 23 greater than the inner-electrode gap (G); and R7. the margin (H) of the inner electrode 30 greater than the inner-electrode gap (G).

More specially, as shown in FIG. 2, given that the upper cap 23, the inner-electrode stack 22 and the lower cap 21 in the MLV 10 have the same impedance, where the inner-electrode gap (G) is greater than the thickness (T) of the lower cap 21 (and the upper cap 23) as well as the margin (H) of the inner electrodes 30, the current would not pass through the layers of the inner electrodes 30 in the inner-electrode stack 22 as normally expected. Instead, the current would go the shortest route between the uppermost (or bottommost) inner electrode 30 and the outer electrodes 40, as indicated by the dotted-line circle B in FIG. 2. In this case, the current passes through the MLV 10 at the smallest current-carrying area, and once the externally applied voltage is increased, the material at the dotted-line circle B of FIG. 2 can be punctured, causing damage to the MLV 10.

Consequently, if the size of the MLV remains unchanged, increase of the number of layers of the inner electrodes 30 is limited as the MLV 10 has to satisfy the foregoing conditions R5-R7. This prevents increase of the current-carrying area of every inner-electrode layer 30, and in turn prevents increase of the overall current-carrying area of the MLV 10.

SUMMARY OF THE INVENTION

In view of this, it is an object of the present invention to provide a process for producing a multilayer varistor (MLV)

having an increased current-carrying area, and more specially, the inventive MLV is not needed to make dimensionally larger, but it has an increased current-carrying area under requirement of keeping its dimensions the same.

It is another object of the present invention to provide a process for producing a multilayer varistor (MLV) involves to make a lower cap, a upper cap and a margin of inner electrodes formed from a high-impedance material, or alternatively involves to make a MLV sintered body immersed into a low-valence alkali metal ion solution of 5-80% concentration for at least 2 minutes to significantly increase the impedance at the areas at issue, so that to make the thickness of the lower cap and of the upper cap become thinned as well as to make the margin of the inner electrodes become narrowed is possible. In this manner, the MLV with the same dimension as before can have more layers of inner electrodes and in turn increased current-carrying area of every inner-electrode layer as well as increased MLV's overall current-carrying area without dimensionally increasing the MLV, thereby improving the performance of the multilayer varistor.

It is another object of the present invention to provide a multilayer varistor (MLV) comprises a ceramic body having interdigitated inner electrodes inside, and two outer electrodes each covered onto one end of the ceramic body to connect with the interdigitated inner electrodes in electrical connection, wherein the ceramic body is formed from laminating a lower cap, an inner-electrode stack and an upper cap into a unity, and satisfies the following conditions:

1. both the lower cap and the upper cap each has a thickness (t) that is equal to 0.10-0.99 times of an inner-electrode gap (g) spaced out between two adjacent inner electrodes;
2. the inner electrodes have a margin (h) that is equal to 0.10-0.99 times of the inner-electrode gap (g); and
3. in the inner-electrode stack of the MLV, an impedance generated from the inner-electrode gap (g) spaced out between two adjacent inner electrodes is less than an impedance which may be generated from the lower cap, the upper cap or the margin (h) of the inner electrodes.

It is another object of the present invention to provide a multilayer varistor (MLV) which is produced from the aforesaid process under the control of keeping dimensionally unchanged and has the following beneficial effects:

1. having an increased number of layers of the inner electrodes;
2. having an increased current-carrying area of every inner-electrode layer; and
3. having an increased overall current-carrying area for the produced multilayer varistor.

DETAILED DESCRIPTION OF THE INVENTION

Figure 3:
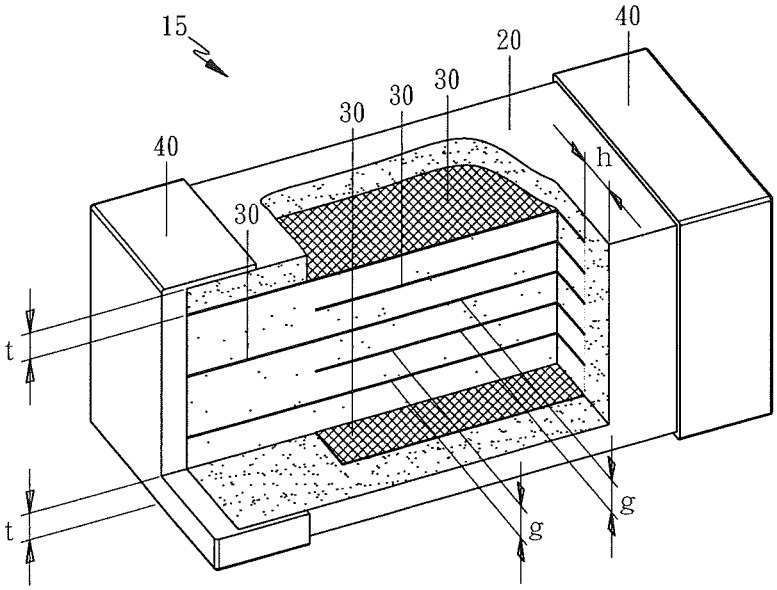
FIG. 3 is a cutaway perspective view of a multilayer varistor according to the present invention.
Figure 4:
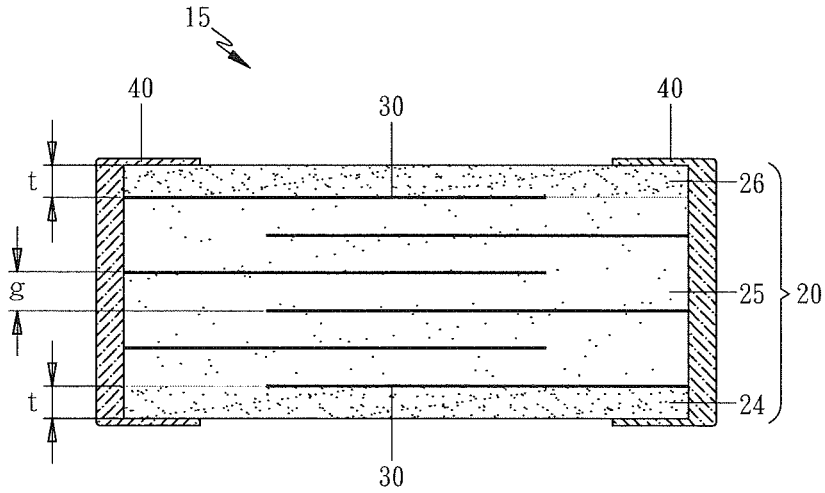
FIG. 4 is a cross-sectional view of the multilayer varistor of FIG. 3.

As shown in FIG. 3 and FIG. 4, a multilayer varistor (MLV) 15 of the present invention comprises a ceramic body 20 having interdigitated inner electrodes 30 inside, and two outer electrodes 40 each covered onto one end of the ceramic body 20 to connect with the interdigitated inner electrodes 30 in electrical connection.

In particular, the ceramic body 20 of the MLV 15 of the present invention is a sandwiched structure formed from laminating a lower cap 24, an inner-electrode stack 25 and an upper cap 26 into a unity, and satisfies the following conditions R1-R4:

R1. the lower cap 24 has a thickness (t) that is equal to 0.10-0.99 times of an inner-electrode gap (g) spaced out between two adjacent inner electrodes 30;

R2. the upper cap 26 has a thickness (t) that is equal to 0.10-0.99 times of the inner-electrode gap (g);

R3. the inner electrodes 30 have a margin (h) that is equal to 0.10-0.99 times of the inner-electrode gap (g); and R4. in the inner-electrode stack 25, an impedance generated from the inner-electrode gap (g) spaced out between two adjacent inner electrodes 30 is less than an impedance which may be generated from the lower cap 24, the upper cap 26 or the margin (h) of the inner electrodes 30.

Preferably, the ceramic body 20 has the lower cap 24, the inner-electrode stack 25 and the upper cap 26 to satisfy the following conditions K1-K4:

K1. the lower cap 24 has a thickness (t) that is equal to 0.15-0.80 times of an inner-electrode gap (g) spaced out between two adjacent inner electrodes 30;

K2. the upper cap 26 has a thickness (t) that is equal to 0.15-0.80 times of the inner-electrode gap (g);

K3. the inner electrodes 30 have a margin (h) that is equal to 0.15-0.80 times of the inner-electrode gap (g); and K4. in the inner-electrode stack 25, an impedance generated from the inner-electrode gap (g) spaced out between two adjacent inner electrodes 30 is less than an impedance which may be generated from the lower cap 24, the upper cap 26 or the margin (h) of the inner electrodes 30.

The disclosed multilayer varistor 15 of the present invention may be made using two methods. The first method for making the multilayer varistor 15 involves making the lower cap 24, the upper cap 26, and the margin (h) of the inner electrodes 30 of the multilayer varistor 15 with a material whose impedance is higher than the impedance of the inner-electrode stack 25, so that the disclosed multilayer varistor 15 of the present invention satisfies the foregoing conditions R1-R4 or K1-K4.

The second method for making the multilayer varistor 15 of the invention involves:

1. treating an MLV sintered body which is made using a known MLV manufacturing method with immersion in a solution of low-valence alkali metal ions (such as one-valence lithium ions ($Li^+$)); and
2. performing a high-temperature diffusion of the low-valence alkali metal ions (hereinafter referred to as a "step of high-temperature diffusion of low-valence ions") successively, so as to increase impedances of the MLV sintered body and at surfaces of the final MLV product.

Therein, the low-valence alkali metal ions are selected from the group consisting of lithium ions, sodium ions, potassium ions, rubidium ions, cesium ions, and francium ions. Preferably, the alkali metal ions are lithium ions, sodium ions or potassium ions.

Pure ZnO particles were originally insulators. In order to allow pure ZnO particles to display semi-conductive and voltage-dependent properties during proceeding a sintering process, these ZnO particles have to be first doped with high-valence ions and then wrapped by a thin layer of a high-impedance material.

Thus, during preparation of the ceramic body 20 of the disclosed multilayer varistor 15 of the present invention, the step of high-temperature diffusion of low-valence ions as mentioned above was performed on the MLV sintered body, where low-valence alkali metal ions (e.g., one-valence lithium ions) were permeated into the surfaces of all layers of the MLV sintered body, so as to make the ZnO particles less semi-conductive due to the doping of the low-valence alkali metal ions, and have increased impedance.

Hence, the second method of the present invention for preparing the disclosed multilayer varistor 15 is so different from the known MLV making method that such a step of high-temperature diffusion of low-valence ions is additionally performed on the MLV sintered body by immersing the MLV sintered body immersion into a low-valence alkali metal ion solution of 5-80% concentration, preferably 40-80% concentration, for at least 2 minutes, preferably 2-60 minutes, more preferably 5-20 minutes, and most preferably 10-12 minutes.

Therein, the concentration of the alkali metal ion solution and the immersion time determine how deep the low-valence ions go into the layers of the MLV sintered body. After completion of immersion in a solution of low-valence alkali metal ions, the MLV sintered body after dried to removal of water is heated at 650-900° C., preferably 700-900° C., and more preferably 800-875° C. to finish the step of high-temperature diffusion. This step makes the impedance of the lower cap 24, the upper cap 26 and the margin (h) of the inner electrodes 30 in the MLV sintered body higher than the impedance of the inner-electrode gap (g).

The second method of the present invention relates to make the impedance at the surfaces of the layers of the MLV sintered body higher than the impedance at its inner-electrode gap (g). This outstanding phenomenon not only breaks the limitation of the conventional MLV manufacturing method, but also makes the multilayer varistor 15 disclosed by the present invention meaningfully satisfy the foregoing conditions R1-R4 or K1-K4.

More specially, the second method for making the disclosed multilayer varistor 15 of the present invention, as shown in FIG. 3 and FIG. 4, comprises the following steps:

1) preparing ZnO ceramic slurries;
2) spreading the prepared ZnO ceramic slurries into green tapes as thick as 10-100 μm by doctor blade technique;
3) piling plural said prepared green tapes and laminating them into a lower cap 24 (or an upper cap 26) having a predetermined thickness (t), preferably having a thickness up to 200 μm or above;
4) printing an inner electrode 30 on the prepared lower cap 24 with a margin (h) left around each side edge of the inner electrode 30, wherein the inner electrode 30 may be made of platinum (Pt), palladium (Pd), gold (Au), silver (Ag), nickel (Ni), or an alloy of any two or more from the foregoing metals;
5) piling plural said prepared green tapes of step 2) until the resulting stack has a thickness reaching a predetermined inner-electrode gap (g), and printing interdigitated inner electrodes 30 thereon;
6) according to how much layers of the inner electrodes 30 shall have, repeating piling the inner-electrode gap (g) and printing the interdigitated inner electrodes 30, until an inner-electrode stack 25 as predetermined is obtained, wherein the number of layers of the inner electrodes 30 is 2-25 layers, and preferably 4-12 layers;
7) placing the preformed upper cap 26 onto the top of the inner-electrode stack 25, and laminating the lower cap 24, the inner-electrode stack 25 and the upper cap 26 into a unity as an MLV green body; and the following conditions are satisfied:
   a) the thickness (t) of the lower cap 24 as well as of the upper cap 26 is smaller than a thickness of the inner-electrode gap (g), but equal to or greater than 0.1 times of the thickness of the inner-electrode gap (g); and
   b) the margin (h) left from the inner electrode 30 is smaller than the thickness of the inner-electrode gap (g), but equal to or greater than 0.1 times of the thickness of the inner-electrode gap (g);
8) sintering the MLV green body in a sintering furnace at a sintering temperature of 800-1000° C., so as to obtain an MLV sintered body;
9) performing a step of high-temperature diffusion of low-valence alkali metal ions on the MLV sintered body made of step 8) by immersing the MLV sintered body into an alkali metal ion solution of 5-80% concentration, preferably 40-80% concentration, for at least 2 minutes, preferably 2-60 minutes, more preferably 5-20 minutes, and most preferably 10-12 minutes, and after completion of immersion heating the MLV sintered body at 650-900° C., preferably 700-900° C., more preferably 800-875° C., and most preferably 845-850° C.; and
10) attaching outer electrodes 40 at two ends of the MLV sintered body made in the previous step, and sintering the MLV sintered body at 600-950° C., so as to obtain the multilayer varistor 15, wherein the outer electrodes 40 may be made of silver (Ag), copper (Cu) or silver-palladium alloy.

Under the control of keeping dimensionally unchanged, the multilayer varistor 15 made from the disclosed method of the present invention is favorable to have the following unexpected effects superior to those multilayer varistors commonly known in prior arts:

1. the multilayer varistor 15 of the present invention may increase the laminated number of inner electrodes 30 by intentionally thinning the thickness of the lower cap 24 or the upper cap 26 individually or both, such a manner helps the produced multilayer varistor 15 with inner electrodes 30 up to 12-14 layers or more;
2. the multilayer varistor 15 of the present invention may help every inner electrodes 30 with an increased current-carrying area by intentionally narrowing the margin (h) of the inner electrodes 30 of the inner-electrode stack 25; and
3. the multilayer varistor 15 of the present invention may increase the laminated number of inner electrodes 30 as well as help every inner electrodes 30 with an increased current-carrying area simultaneously, by intentionally thinning the thickness of the lower cap 24 or/and the upper cap 26 and narrowing the margin (h) of the inner electrodes 30 of the inner-electrode stack 25.

As far as the multilayer varistor 15 made from the disclosed method of the present invention is concerned, the more layers of inner electrodes 30 have, the more layers of the inner-electrode gap (g) are existed.

More specially, under the control of keeping dimensionally unchanged, the disclosed multilayer varistor 15 of the present invention can advantageously promote to have more layers of inner electrodes 30 and also to increase its own overall current-carrying area thereof, since the multilayer varistor 15 have itself owned how much overall current-carrying area is the product via a mathematical calculation to have a current-carrying area owned by a single inner electrode 30 taken as a multiplicand and get multiplied of the total number of layers of the inner-electrode gap (g) (i.e., which is taken as a multiplier).

Accordingly, the physical performance of the multilayer varistor 15 of the present invention is outstandingly improved without dimensionally making the multilayer varistor 15 larger.

In the following paragraphs, examples will be described for further illustrating the present invention without limiting the scope of the present invention. Those tested samples of multilayer varistors for used in the examples and the comparative examples were produced according to the specifications shown in Table 1, and the tested samples were measured using a surge absorber tester modeled MOV-168 and manufactured by TTK (Think Technologies CO., Ltd., Taiwan) for their respective physical properties.

TABLE 1

| Sample for MLV in Specification | | | | |
|---|---|---|---|---|
| Model | Number of layers of inner electrodes | Length (L) | Width (W) | Thickness (T) |
| 0805 | 2~8 | 2.2 ± 0.2 mm | 1.6 ± 0.15 mm | Max 1.5 mm |
| 1206 | 5~6 | 3.2 ± 0.2 mm | 1.6 ± 0.15 mm | Max 1.5 mm |
| 1208 | 7 | 3.2 ± 0.2 mm | 2.2 ± 0.2 mm | Max 1.5 mm |
| 1210 | 8 | 3.2 ± 0.2 mm | 2.5 ± 0.2 mm | Max 1.5 mm |
| 1812 | 8 | 4.5 ± 0.2 mm | 3.2 ± 0.2 mm | Max 2.0 mm |
| 2220 | 10~20 | 5.70 ± 0.2 mm | 5.0 ± 0.2 mm | Max 2.5 mm |
| 3220 | 4 | 8.10 ± 0.3 mm | 5.0 ± 0.3 mm | Max 3.0 mm |

Examples 1-3 and Comparative Examples 1-3

The multilayer varistors modeled 0805, 1206 and 1210 in Table 2 were taken as subjects.

The sample multilayer varistors for Comparative Examples 1-3 were made using the known MLV manufacturing method, while the sample multilayer varistors for Example 1-3 were prepared using the disclosed method which is different from the known MLV manufacturing method.

The 0805- and 1206-MLV sintered bodies of Examples 1 and 2 is respectively immersed in a lithium-ion solution of 40% concentration for 15 minutes, after drying to removal of water, and then performing the step of high-temperature diffusion of low-valence alkali metal ions at 845° C.

The 1210-MLV sintered body of Example 3 is immersed in a lithium-ion solution of 80% concentration for 12 minutes, after drying it, and then performing the step of high-temperature diffusion of low-valence alkali metal ions at 850° C.

The sample multilayer varistors were measured for their respective physical properties, and the results are show in Table 2.

The sample multilayer varistors of Examples 1-3 and of Comparative Example 1-3 were measured for their basic electrical properties at their outer electrodes such as the breakdown voltage, the nonlinear coefficient and the leakage current, and no significant changes were noticed.

However, according to Table 2, the sample multilayer varistors of Examples 1-3 are far greater than the sample multilayer varistors of Comparative Examples 1-3 in terms of current-carrying capacity. This indicates that the ceramic bodies 20 of the sample multilayer varistors of Examples 1-3 had increased peripheral impedance.

In other words, the results shown in Table 2 indicate during the step of high-temperature diffusion of low-valence ions performed on the sample MLV sintered bodies, by adjusting the concentration of the lithium-ion solution used and the immersion time, the diffusion of the low-valence lithium ions were controlled to only reach the zinc oxide particles in the lower cap 24, in the upper cap 26, and in the margin (h) of the inner electrodes 30 in the MLV sintered bodies, without affecting zinc oxide particles in the inner-electrode gap (g) of the inner-electrode stack 25.

As a result, the impedance at the lower cap 24, the upper cap 26, and the margin (h) of the inner electrodes 30 in the MLV sintered body was increased and became higher than the impedance at the inner-electrode gap (g) of the inner-electrode stack 25.

These results also prove that the multilayer varistor made using the disclosed method can have its lower cap 24 and upper cap 26 thinner and have its margin (h) of the inner electrodes 30 reduced without changing its dimensions.

Examples 4-6 and Comparative Examples 4-6

The multilayer varistors modeled 0805, 1206 and 1210 made as those for Examples 1-3 and Comparative Examples 1-3 were taken as samples of Examples 4-6 and Comparative Examples 4-6, respectively.

The samples were measured for the inner-electrode gap (g), the lower cap's thickness, the upper cap's thickness, the number of inner-electrode layers, every inner-electrode layer's current-carrying area, and the overall current-carrying area thereof, the results are shown in Table 3.

TABLE 2

| | MLV | | | | | |
|---|---|---|---|---|---|---|
| | Example 1 | Comparative Example 1 | Example 2 | Comparative Example 2 | Example 3 | Comparative Example 3 |
| Sample model | 0805 | | 1206 | | 1210 | |
| Breakdown voltage (V) | 485 | 475 | 450 | 465 | 465 | 458 |
| Nonlinear coefficient (α) | 80.3 | 78 | 78.4 | 74 | 68 | 69 |
| Leakage current (μA) | 0.22 | 0.43 | 0.29 | 0.3 | 0.45 | 0.45 |
| Clamping voltage ratio | 1.16 | 1.16 | 1.13 | 1.19 | 1.16 | 1.21 |
| Capacitance (pF) | 36 | 30 | 55 | 34 | 180 | 105 |
| Current-carrying capacity (A) | 150 | 88 | 220 | 120 | 750 | 350 |

TABLE 3

| | MLV | | | | | |
|---|---|---|---|---|---|---|
| | Example 4 | Comparative Example 4 | Example 5 | Comparative Example 5 | Example 6 | Comparative Example 6 |
| Sample model | 0805 | | 1206 | | 1210 | |
| Inner-electrode gap (μm) | 300 | 300 | 360 | 360 | 380 | 380 |
| Thickness of lower or upper cap (μm) | 150 | 450 | 180 | 540 | 190 | 570 |
| Number of layers of inner electrodes | 6 | 4 | 6 | 4 | 8 | 6 |
| Margin of inner electrode (μm) | 200 | 400 | 200 | 500 | 200 | 550 |
| Current-carrying area of single inner electrode ($mm^2$) | 2.8 | 1.73 | 4.8 | 2.8 | 7.8 | 5.48 |
| Overall current-carrying area ($mm^2$) | 14.0 | 5.19 | 24 | 8.4 | 54.6 | 27.4 |

Figure 1:
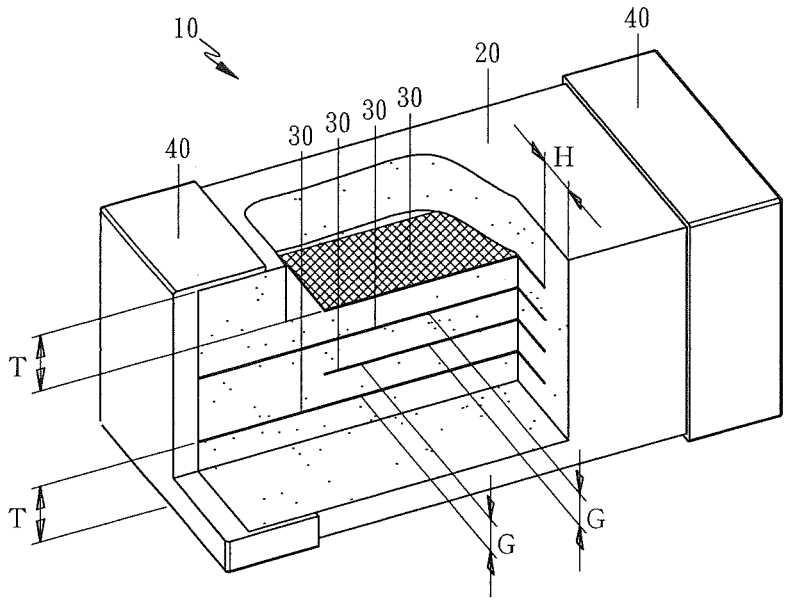
FIG. 1 is a cutaway perspective view of a known multilayer varistor.
Figure 2:
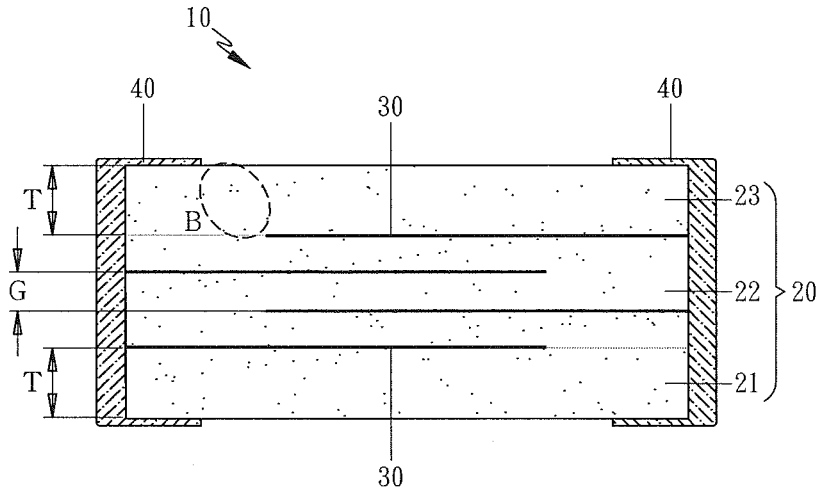
FIG. 2 is a cross-sectional view of the multilayer varistor of FIG. 1.

The sample multilayer varistors for Comparative Examples 4-6 were made using the known MLV manufacturing method and are as shown in FIG. 1, and their inner-electrode gap (G) is smaller than the thickness (T) of the lower cap (and the upper cap), and smaller than the margin (H) of the inner electrode.

On the other hand, the sample multilayer varistors for Examples 4-6 were made using the disclosed method and are as shown in FIG. 3. Their impedance at the lower cap 24, the upper cap 26 and the margin (h) of the inner electrodes 30 in the ceramic body 20 is higher than the impedance at the inner-electrode gap (g) of the inner-electrode stack 25, and they satisfy the following conditions K5-K7:

K5. the thickness (t) of the lower cap is 0.5 times of the inner-electrode gap (g);

K6. the thickness (t) of the upper cap is 0.5 times of the inner-electrode gap (g); and K7. the margin (h) of the inner electrode is 0.53-0.67 times of the inner-electrode gap (g).

As the results shown in Table 3, the sample multilayer varistors for Examples 4-6 had 6-8 layers of inner electrodes and total current-carrying area of 14.0-54.6 $mm^2$ compared to 4-6 layers of inner electrodes and total current-carrying area of 5.19-27.4 $mm^2$ of sample multilayer varistors for the Comparative Examples 4-6.

By comparison in respect of physical properties, the sample multilayer varistors for Examples 4-6 are far greater than the sample multilayer varistors for Comparative Examples 4-6 with the same dimensions.

Examples 7-8

The multilayer varistors modeled 0805 and 2220 made for Example 7 and Example 8 were respectively measured for the inner-electrode gap (g), the lower cap's thickness, the upper cap's thickness, the number of inner-electrode layers, every inner-electrode layer's current-carrying area, and the overall current-carrying area thereof, the results are shown in Table 4.

TABLE 4

| MLV | Example 4 | Example 6 |
|---|---|---|
| Sample model | 0805 | 2220 |
| Inner-electrode gap (μm) | 246 | 250 |
| Thickness of lower or upper cap (μm) | 37 | 200 |
| Number of layers of inner electrodes | 8 | 10 |

TABLE 4-continued

| MLV | Example 4 | Example 6 |
|---|---|---|
| Margin of inner electrode (μm) | 37 | 200 |
| Current-carrying area of single inner electrode ($mm^2$) | 3.67 | 27 |
| Overall current-carrying area ($mm^2$) | 25.69 | 243 |

According to the results shown in Table 4, the sample multilayer varistors for Examples 7-8 were made using the disclosed method and are as shown in FIG. 3. Their impedance at the lower cap 24, the upper cap 26 and the margin (h) of the inner electrodes 30 in the ceramic body 20 is higher than the impedance at the inner-electrode gap (g) of the inner-electrode stack 25, and they satisfy the following conditions K8-K10:

K8. the thickness (t) of the lower cap is 0.15-0.8 times of the inner-electrode gap (g);

K9. the thickness (t) of the upper cap is 0.15-0.8 times of the inner-electrode gap (g);

and

K10. the margin (h) of the inner electrode is 0.15-0.8 times of the inner-electrode gap (g).

Examples 9-15

The multilayer varistors modeled 0806, 1206, 1208, 1210, 1812, 2220 and 3220 were made using the disclosed method and used as the sample multilayer varistors for Example 9-15.

During performing the step of high-temperature diffusion of low-valence ions, the multilayer varistors (MLV) sintered bodies of Example 9-15 were respectively immersed in lithium-ion solutions of 5-70% concentration according to their respective Li-doping conditions as stated in Table 5 for at least 2 minutes, and, after dried to removal of water, undergone the step of high-temperature diffusion of lithium ions at 650-900° C.

The sample multilayer varistors for Example 9-15 were measured for their respective physical properties, and the results are show in Table 5.

TABLE 5

| | MLV | | | | | | |
|---|---|---|---|---|---|---|---|
| | Example 9 | Example 10 | Example 11 | Example 12 | Example 13 | Example 14 | Example 15 |
| Sample model | 0805 | 1206 | 1208 | 1210 | 1812 | 2220 | 3220 |
| lithium-ion concentration | 5% | 20% | 30% | 40% | 50% | 60% | 70% |
| Immersion time (min) | 30 | 20 | 20 | 15 | 15 | 8 | 8 |
| Li-doping temperature (° C.) | 650 | 700 | 750 | 800 | 850 | 875 | 900 |
| Inner-electrode gap (μm) | 1100 | 260 | 260 | 290 | 310 | 160 | 704 |
| Thickness of lower or upper cap (μm) | 250 | 240 | 210 | 180 | 210 | 150 | 150 |
| Number of layers of inner electrodes | 2 | 5 | 7 | 8 | 8 | 20 | 4 |
| Margin of inner electrode (μm) | 130 | 130 | 180 | 180 | 230 | 155 | 180 |
| Current-carrying area of single inner electrode ($mm^2$) | 1.85 | 3.52 | 4.63 | 6.04 | 12.04 | 23.25 | 31.82 |
| Overall current-carrying area ($mm^2$) | 1.85 | 14.08 | 27.78 | 42.28 | 84.28 | 441.75 | 95.46 |
| Breakdown voltage (V) | 448 | 427 | 421 | 455 | 460 | 25.6 | 833 |
| Nonlinear coefficient (α) | 80 | 80 | 75 | 81 | 66 | 32 | 70 |
| Leakage current (μA) | 0.4 | 0.5 | 0.4 | 0.8 | 2 | 4 | 1.3 |
| Clamping voltage ratio | 1.18 | 1.16 | 1.23 | 1.19 | 1.17 | 1.48 | 1.24 |
| Capacitance (pF) | 30 | 70 | 105 | 190 | 340 | 13500 | 200 |
| Current-carrying capacity (A) | 180 | 260 | 400 | 650 | 1500 | 12000 | 1400 |

According to the results shown in Table 5, the sample multilayer varistors for Examples 9-15 were made using the disclosed method and are as shown in FIG. 3. Their impedance at the lower cap 24, the upper cap 26 and the margin (h) of the inner electrodes 30 in the ceramic body 20 is higher than the impedance at the inner-electrode gap (g) of the inner-electrode stack 25, and they satisfy the following conditions K11-K13:

K11. the thickness (t) of the lower cap is 0.213-0.938 times of the inner-electrode gap (g);

K12. the thickness (t) of the upper cap is 0.213-0.938 times of the inner-electrode gap (g); and K13. the margin (h) of the inner electrode is 0.118-0.969 times of the inner-electrode gap (g).

In addition, according to the results shown in Table 5, with the same dimensions, the sample multilayer varistors for Examples 9-15 had 2-20 layers of inner electrodes and total current-carrying area of 1.85-441.75 $mm^2$.

Results:

By comparing Examples 1-15 and Comparative Examples 1-6, it is found that the disclosed method and the disclosed multilayer varistor of the present invention achieved more layers of inner electrodes, larger current-carrying area of every inner-electrode layer, and larger overall current-carrying area of the multilayer varistor with the same dimensions, and thus contributed to improve performance of the multilayer varistor outstandingly.

What is claimed is:

1. A process for producing a multilayer varistor having an increased current-carrying area, comprising the following steps:

a) spreading a prepared ZnO ceramic slurry into green tapes having a thickness ranged from 10 μm to 100 μm by doctor blade technique;

b) making a lower cap and an upper cap each having a predetermined thickness (t) via piling plural prepared green tapes of step a) respectively;

c) printing an inner electrode on the prepared lower cap of step b) with a margin (h) left around each side edge of the inner electrode;

d) piling plural prepared green tapes of step a) onto the lower cap of step c) until a resulting stack has a thickness reaching a predetermined inner-electrode gap (g), and printing an interdigitated inner electrode thereon to leave a margin (h) around each side edge of the inner electrode;

e) repeatedly stacking the inner-electrode gap (g) and printing the interdigitated inner electrodes until to obtain an inner-electrode stack having a predetermined number of layers of the inner electrodes;

f) placing the preformed upper cap onto the top of the inner-electrode stack, and laminating the lower cap, the inner-electrode stack and the upper cap into a unity as a multilayer varistor (MLV) green body, and the following conditions are satisfied:

f1) the thickness (t) of the lower cap and of the upper cap is smaller than a thickness of the inner-electrode gap (g), but equal to or greater than 0.1 times of the thickness of the inner-electrode gap (g); and f2) the margin (h) left from the inner electrode is smaller than the thickness of the inner-electrode gap (g), but equal to or greater than 0.1 times of the thickness of the inner-electrode gap (g);

g) obtaining an MLV sintered body by sintering the MLV green body in a sintering furnace at a sintering temperature of 800-1000° C.;

h) immersing the MLV sintered body into an alkali metal ion solution having a concentration of 5-80% for at least 2 minutes, and, after dried, performing a step of high-temperature diffusion of low-valence alkali metal ions at a temperature of 650-900° C.;

i) attaching outer electrodes to two ends of the MLV sintered body made in Step h), and sintering the MLV sintered body at 600-950° C. to obtain a final produced multilayer varistor.

2. The process for producing a multilayer varistor of claim 1, wherein the alkali metal ion solution is a lithium ion solution, a sodium ion solution, a potassium ion solution, a rubidium ion solution, a cesium ion solution, or a francium ion solution.

3. The process for producing a multilayer varistor of claim 2, wherein the lower cap or the upper cap at least has a thickness of 200 μm.

4. The process for producing a multilayer varistor of claim 2, wherein the inner electrode is made of platinum (Pt), palladium (Pd), gold (Au), silver (Ag), nickel (Ni), or an alloy formed from any two or more metals selected from the foregoing metals; and the outer electrode is made of silver (Ag), copper (Cu) or silver-palladium alloy.

5. The process for producing a multilayer varistor of claim 2, wherein at step h) the MLV sintered body is immersed into the alkali metal ion solution having a concentration of 40-80% for 2-60 minutes.

6. The process for producing a multilayer varistor of claim 2, wherein at step h) the step of high-temperature diffusion of low-valence alkali metal ions is performed at a temperature of 800-875° C.

7. The process for producing a multilayer varistor of claim 2, wherein at step h) the step of high-temperature diffusion of low-valence alkali metal ions is performed at a temperature of 845-850° C.

8. The process for producing a multilayer varistor of claim 1, wherein the alkali metal ion solution is a lithium ion solution, a sodium ion solution or a potassium ion solution.

9. A multilayer varistor produced by the process of claim 1, comprising a ceramic body having interdigitated inner electrodes with a spaced layout inside, and two outer electrodes each covered onto one end of the ceramic body to electrically connect with the interdigitated inner electrodes;

wherein the ceramic body has a sandwich structure formed from laminating a lower cap, an inner-electrode stack and an upper cap into a unity, and satisfies the following conditions R1-R4:

R1) the lower cap has a thickness (t) that is equal to 0.10-0.99 times of an inner-electrode gap (g) spaced out between two adjacent interdigitated inner electrodes;

R2) the upper cap has a thickness (t) that is equal to 0.10-0.99 times of the inner-electrode gap (g);

R3) a margin (h) left from each of two side edges of the interdigitated inner electrode is equal to 0.10-0.99 times of the inner-electrode gap (g); and R4) an impedance generated from the inner-electrode gap (g) is less than an impedance generated from the lower cap, the upper cap and the margin (h) of the inner electrodes.

10. The multilayer varistor of claim 9, wherein the ceramic body satisfies the following conditions K1-K4:

K1) the lower cap has a thickness (t) that is equal to 0.15-0.80 times of an inner-electrode gap (g) spaced out between two adjacent interdigitated inner electrodes;

K2) the upper cap has a thickness (t) that is equal to 0.15-0.80 times of the inner-electrode gap (g);

K3) a margin (h) left from each of two side edges of the interdigitated inner electrode is equal to 0.15-0.80 times of the inner-electrode gap (g); and K4) an impedance generated from the inner-electrode gap (g) is less than an impedance generated from the lower cap, the upper cap and the margin (h) of the inner electrodes.

11. The multilayer varistor of claim 9, wherein the ceramic body has 2-25 layers of the inner electrodes.

12. The multilayer varistor of claim 9, wherein the ceramic body has 4-12 layers of the inner electrodes.

* * * * *